US007584588B2

(12) United States Patent
Kim

(10) Patent No.: US 7,584,588 B2
(45) Date of Patent: Sep. 8, 2009

(54) DOOR FRAME SYSTEM HAVING FIXED BENCH, PRESSURE BENCH, AND COMPRESSION RAIL

(76) Inventor: Min Sig Kim, 18503 Stonegate La., Rowland Heights, CA (US) 91748

( * ) Notice: Subject to any disclaimer, the term of this patent is extended or adjusted under 35 U.S.C. 154(b) by 125 days.

(21) Appl. No.: 11/309,288

(22) Filed: Jul. 21, 2006

(65) Prior Publication Data

US 2007/0256383 A1 Nov. 8, 2007

Related U.S. Application Data

(60) Provisional application No. 60/798,076, filed on May 5, 2006.

(51) Int. Cl.
*E04C 2/38* (2006.01)
*E06B 3/72* (2006.01)

(52) U.S. Cl. ..... 52/800.14; 52/204.65; 52/204.597

(58) Field of Classification Search ..... 52/204.597, 52/204.62, 204.64, 204.65, 204.591, 656.5, 52/656.6, 656.7, 800.14
See application file for complete search history.

(56) References Cited

U.S. PATENT DOCUMENTS

| | | | | | |
|---|---|---|---|---|---|
| 1,985,174 | A | * | 12/1934 | Kneeshaw | 52/771 |
| 2,777,173 | A | * | 1/1957 | Caswall | 52/800.14 |
| 3,593,963 | A | * | 7/1971 | Horgan, Jr. | 256/24 |
| 3,789,564 | A | * | 2/1974 | Kessler | 52/127.5 |
| 3,992,843 | A | * | 11/1976 | DiFazio | 52/204.593 |
| 4,004,389 | A | * | 1/1977 | DiFazio | 52/204.593 |
| 4,054,268 | A | * | 10/1977 | Sher | 256/24 |
| 4,235,049 | A | * | 11/1980 | Marinoni et al. | 49/493.1 |
| 4,423,582 | A | * | 1/1984 | Yates | 52/800.16 |
| 4,655,025 | A | * | 4/1987 | Marinoni | 52/771 |
| 4,671,016 | A | * | 6/1987 | Boeckx | 49/501 |
| 4,680,903 | A | * | 7/1987 | Horgan, Jr. | 52/127.8 |
| 4,837,993 | A | * | 6/1989 | Studenski | 52/208 |
| 4,850,168 | A | * | 7/1989 | Thorn | 52/207 |
| 4,852,312 | A | * | 8/1989 | Harbom | 52/126.3 |
| 4,914,888 | A | * | 4/1990 | Hanson | 52/768 |
| 4,920,717 | A | * | 5/1990 | Hooper, Jr. | 52/204.597 |
| 5,069,010 | A | * | 12/1991 | Trainor et al. | 52/127.8 |
| 5,413,397 | A | * | 5/1995 | Gold | 296/146.15 |
| 5,444,958 | A | * | 8/1995 | Lu | 52/775 |
| 5,483,775 | A | * | 1/1996 | Redman | 52/204.62 |
| 6,327,826 | B1 | * | 12/2001 | Mann | 52/204.1 |
| 6,434,905 | B1 | * | 8/2002 | Sprague | 52/474 |
| 6,668,499 | B2 | * | 12/2003 | Degelsegger | 52/204.62 |
| 6,912,818 | B2 | * | 7/2005 | Sprague | 52/208 |
| 2002/0121071 | A1 | * | 9/2002 | Heung-Bin | 52/800.11 |
| 2002/0195595 | A1 | * | 12/2002 | Shepherd | 256/25 |
| 2006/0070318 | A1 | * | 4/2006 | Chen et al. | 52/204.65 |

* cited by examiner

*Primary Examiner*—Gay Ann Spahn
(74) *Attorney, Agent, or Firm*—Park Law Firm; John K. Park

(57) ABSTRACT

A door frame system includes a frame, a fixed bench, a pressure bench and a compression rail combined to the frame. The pressure bench moves horizontally by a tightening bolt so as to compress and fasten a glass pane, and a brush assembly is combined to a lower space portion of the frame. With the tightening bolt in a locking position, the compression rail is lifted up along an inclined guide surface and horizontally moves the closely contacting pressure bench. The frame and the glass pane can be firmly combined without being pushed out from each other and a door of a precise standard can be provided.

4 Claims, 15 Drawing Sheets

DOOR FRAME SYSTEM HAVING FIXED BENCH, PRESSURE BENCH, AND COMPRESSION RAIL

RELATED APPLICATION

This application is a corresponding non-provisional application of U.S. Provisional Patent Application Ser. No. 60/798,076 for "Door Frame System" filed on May 5, 2006.

BACKGROUND OF THE INVENTION

1. Field of the Invention

The present invention relates to a door frame system for a glass door of a building, and more particularly, to a door frame system, which includes a fixed bench not moving when assembled, a horizontally movable pressure bench, a compression rail pushing the pressure bench in a horizontal direction only, and a frame to which the fixed bench, the pressure bench, and the compression rail are assembled, so that the assembled frame is combined with a glass pane.

2. Background Art

U.S. Pat. No. 6,434,905 issued on Aug. 20, 2002 discloses a door rail system. Referring to FIG. 15, the door rail system of the prior art includes: a housing 102 having inclined slide surfaces 122 narrowing downwardly; a pair of clamp members 104*a* and 104*b*, each having an inclined friction surface 120 in parallel with the inclined slide surface 122; a nut strip 108 coupled with a bolt 106 pulling the clamp members 104*a* and 104*b* in one direction so as to simultaneously close the clamp members 104*a* and 104*b*, so that the clamp members can be combined with the glass pane 101.

In more detail, the housing 102 includes the inclined slide surfaces 122 formed at both sides of the upper space thereof in a downward direction and double-layer type bridges 116 and 118. Each clamp member includes the inclined friction surface 120 sliding on the inclined slide surface 122 and a recess 104*a*' or 104*b*' formed at the lower portion thereof. An elongated nut strip 108 which has at least two female screw holes 108*a* is located in the recess 104*a* and 104*b*, and a bolt 106 passes through holes 116*a* and 118*a* perforating the bridges 116 and 118 of the housing 102 and inserted into the female screw hole of the nut strip 108.

A process for manufacturing the door rail system of the prior art is described below. First, the clamp members 104*a* and 104*b* are coupled with each other in such a way that the inclined friction surfaces 120 are respectively in contact with the inclined slide surfaces 122 of the housing 102, and the recesses 104*a*' and 104*b*' face with each other, and then, the elongated nut strip 108 is pushed into the recesses 104*a*' and 104*b*'.

Next, the bolt 106 is inserted into the through holes 116*a* and 118*a*, and then, rotated in such a way as to be fit into the female screw hole 108*a* of the nut strip.

The housing 102 to which the above components are assembled is combined to the upper surface and the lower surface of the glass pane 101 put on a table.

The combining method is as follows. Both ends of the clamp members 104*a* and 104*b* are adjusted to be fit with both ends of the housing 102, and then, the bolt 106 is loosened or tightened in such a way that the glass pane 101 is fit between the clamp members 104*a* and 104*b*. After an interval between the clamp members 104*a* and 104*b* is adjusted, the clamp members 104*a* and 104*b* are fit to the ends of the glass pane 101 in a state where two workers grasp both ends of the glass pane 101, so that the clamp members 104*a* and 104*b* do not separated out from the inside of the housing 102. After that, one worker grasps the housing 102 and the other tightens the bolt 106 so as to combine the housing 102 with the glass pane 101.

As described above, in the prior art, the glass pane is assembled with the housing according to such difficult method, however, when the bolt 106 is tightened to completely assemble the housing 102 to the glass pane 101, the clamp members 104*a* and 104*b* are unsteadily tightened and do not keep a straight line condition with the glass pane 101 while the bolt 106 is tightened.

Furthermore, the clamp members 104*a* and 104*b* are pulled outwardly from the ends of the glass pane 101 while the bolt 106 is tightened. So, finally, the door becomes longer than a set length of a standard door and is not up to the standard, so that workers must repeat attaching and detaching action of the door till the door is fit to a doorframe of a building when the door is installed to the building.

SUMMARY OF THE INVENTION

Accordingly, the present invention has been made to solve the above problems occurring in the prior arts, and it is an object of the present invention to provide a door frame system, which includes: a bench guide formed at a side of the upper part of a frame; a fixed bench detachably mounted on the bench guide and not moving when assembled to the frame; a pressure bench mounted at the front side of the fixed bench for supporting the base side of the fixed bench and compressing a glass pane by moving only in a horizontal direction; a compression rail mounted between the pressure bench and the frame for horizontally moving the pressure bench during ascending upwardly; screw holes formed on a bridge of the frame and opened in a direction facing each other; thick pressure sustaining portions formed at sides of the screw holes, wherein the pressure sustaining portions is not transformed under a heavy pressure; a tightening bolt inserted into a bolt hole perforating the center of the pressure sustaining portions, wherein the tightening bolt pushes the compression rail upwardly; and a brush assembly combined at the bottom of a vertical wall surface of the frame, thereby prevents dust or pollutant air from entering, and allows even a unskilled person to assemble a door easily, rapidly and correctly assemble without departing from the standard.

To accomplish the above objects, according to the present invention, as shown in FIG. 3, there is provided a door frame system including a fixed bench combined at one side of the upper part of a frame for determining a fixed position of a glass pane, a pressure bench for horizontally pushing the glass pane so that the glass pane and the fixed bench are in close contact with each other, a compression rail for horizontally pushing the pressure bench, and a frame to which the fixed bench, the pressure bench and the compression rail are assembled, wherein the assembled frame being combined with the glass pane.

The frame includes an upper space portion, a middle space portion, and a lower space portion. Both sides of the upper space portion get thicker downwardly and respectively have inclined portions for keeping a uniform angle.

As shown in FIG. 4, a flat inclined portion having no slide structure is formed at the right in the drawing, and bench guides are formed at upper and lower portions of the front surface facing the inclined surface portion. The bench guide has a guide groove.

A bridge is formed at the middle space portion of the frame in a double layer form.

The upper bridge includes a support jaw having a support recess 203*a*, screw holes formed on the upper and lower portions of the center thereof at an interval of 10 mm, pressure sustaining portions formed at sides of the screw holes and reinforced thick to endure a heavy load, and bolt holes formed vertically.

The lower space portion of the frame includes balance member guide grooves and brush guide grooves respectively formed at the central portions and lower end portions of both vertical wall surfaces thereof.

The fixed bench, the pressure bench, and the compression rail are assembled and combined to the frame. First, as shown in FIGS. 9*a* and 9*b*, the fixed bench includes a vertical wall closely contacting with a wide end side of the glass pane, a horizontal wall formed on a base side at a right angle to the vertical wall and closely contacting with a cut end portion of the glass pane, a rail formed at the center of the rear side thereof and fit into the guide groove of the frame, a stable protrusion and a seating protrusion formed at both ends of the base side, which are seated on the support jaw of the frame and a low jaw of the pressure bench.

As shown in FIGS. 11*a* and 11*b*, the pressure bench facing the fixed bench and combined to the frame includes a vertical wall closely contacting with a wide end side of the glass pane, a horizontal wall formed on a base side at a right angle to the vertical wall and closely contacting with a cut end portion of the glass pane, an upwardly protruding low jaw horizontally formed below the horizontal wall seating the base side and the seating protrusion of the fixed bench, a downwardly protruding friction portion formed at both sides of the base side thereof and seated on the bridge, a pressure portion getting thicker toward the center of the rear side thereof, and a holding portion, a stepped-form restriction portion and an inclined pressure portion formed below the pressure portion.

Furthermore, as shown in FIGS. 8*a* and 8*b*, the compression rail is in the form of a triangle when it is seen based on both sides of the base side and an apex in section.

In the drawings, the compression rail includes first upper and lower friction surfaces formed at upper and lower portions of the rear side, second upper and lower friction surfaces formed at the opposed side and closely acting to the pressure portion of the pressure bench, a holding portion and a recess to which the holding portion and restriction portion of the pressure bench are entered and seated, the holding portion and the recess being formed between the second upper and lower friction surfaces, and a rising restriction portion.

In addition, as shown in FIG. 3, a tightening bolt for pushing the compression rail upwardly is fit into the bolt holes vertically perforating the center of the pressure sustaining portion of the bridge. Additionally, as shown in FIG. 13, a brush assembly is combined to the lower end of the frame, and the brush assembly includes right-angled upper and lower wings directing vertically, an elastic slot formed between the wings, a brush guide formed at a right angle to the wings and having a brush guide groove, and a brush fit to the brush guide groove.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

The U.S. Provisional Patent Application Ser. No. 60/798,076 by the applicant is incorporated by reference into this disclosure as if fully set forth herein.

Reference will be now made in detail to the preferred embodiment of the present invention with reference to the attached drawings.

Figure 1:
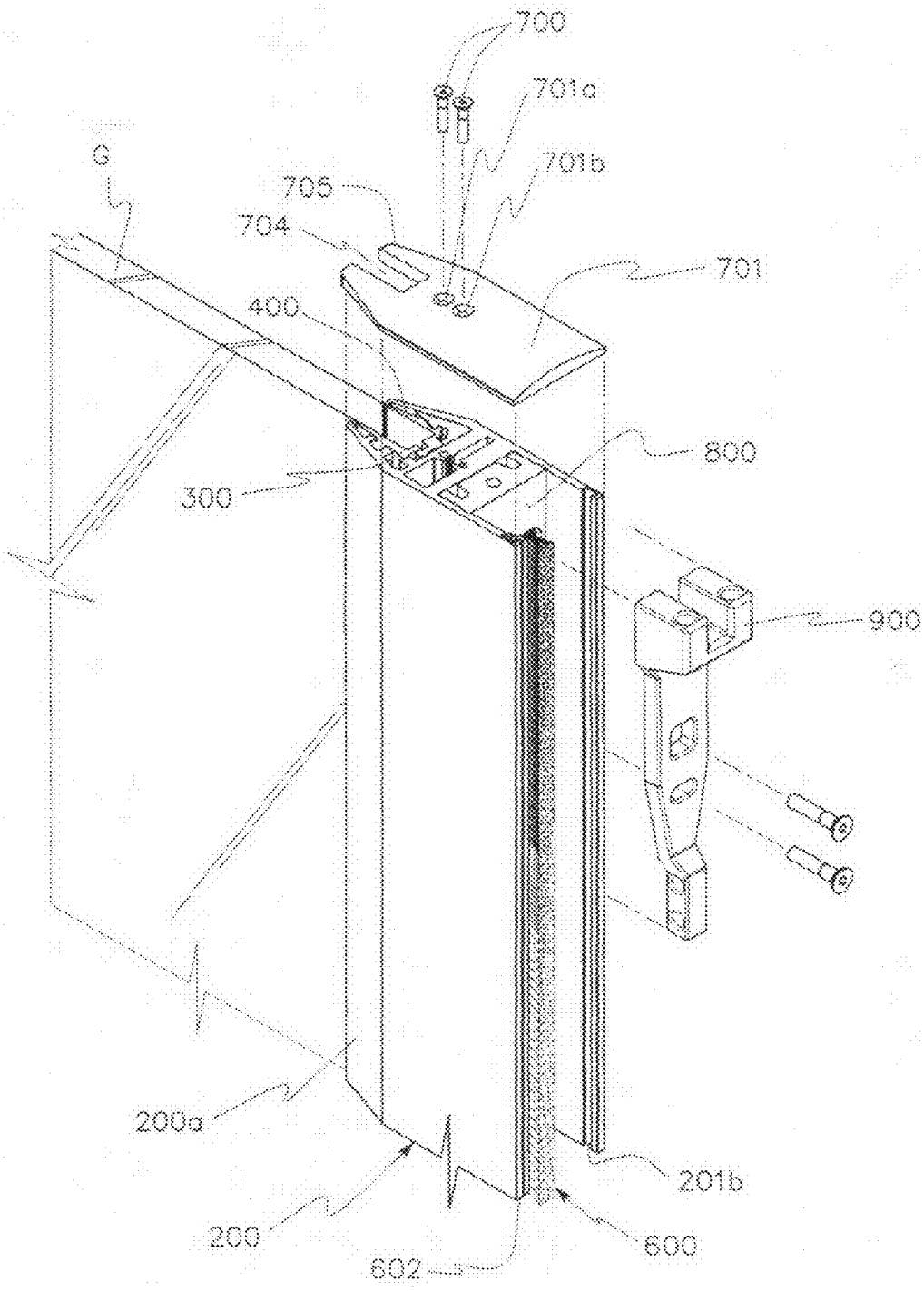
FIG. 1 is a perspective view showing an assembled state of the present invention.
Figure 2:
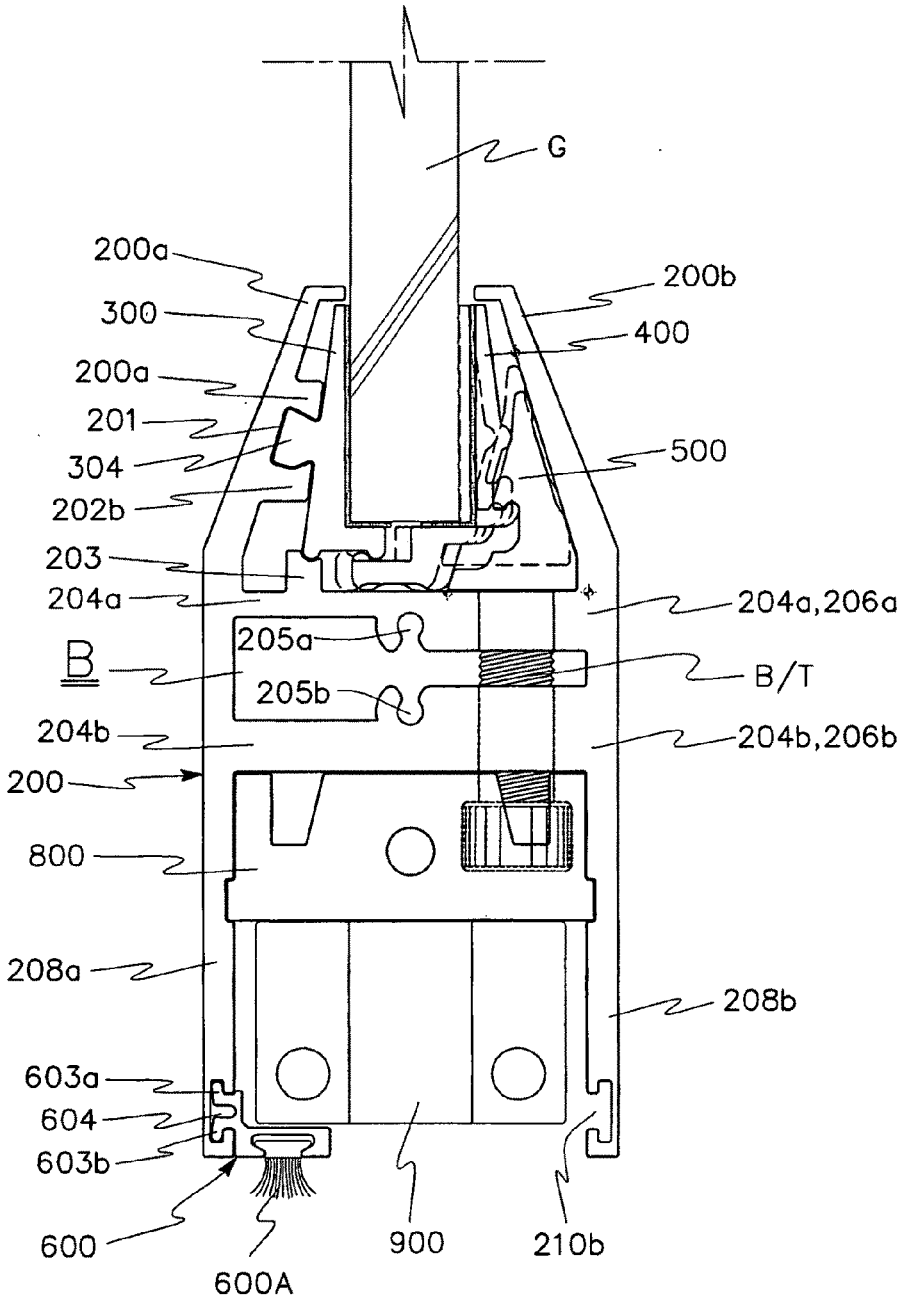
FIG. 2 is a front view for explaining action of the present invention.
Figure 3:
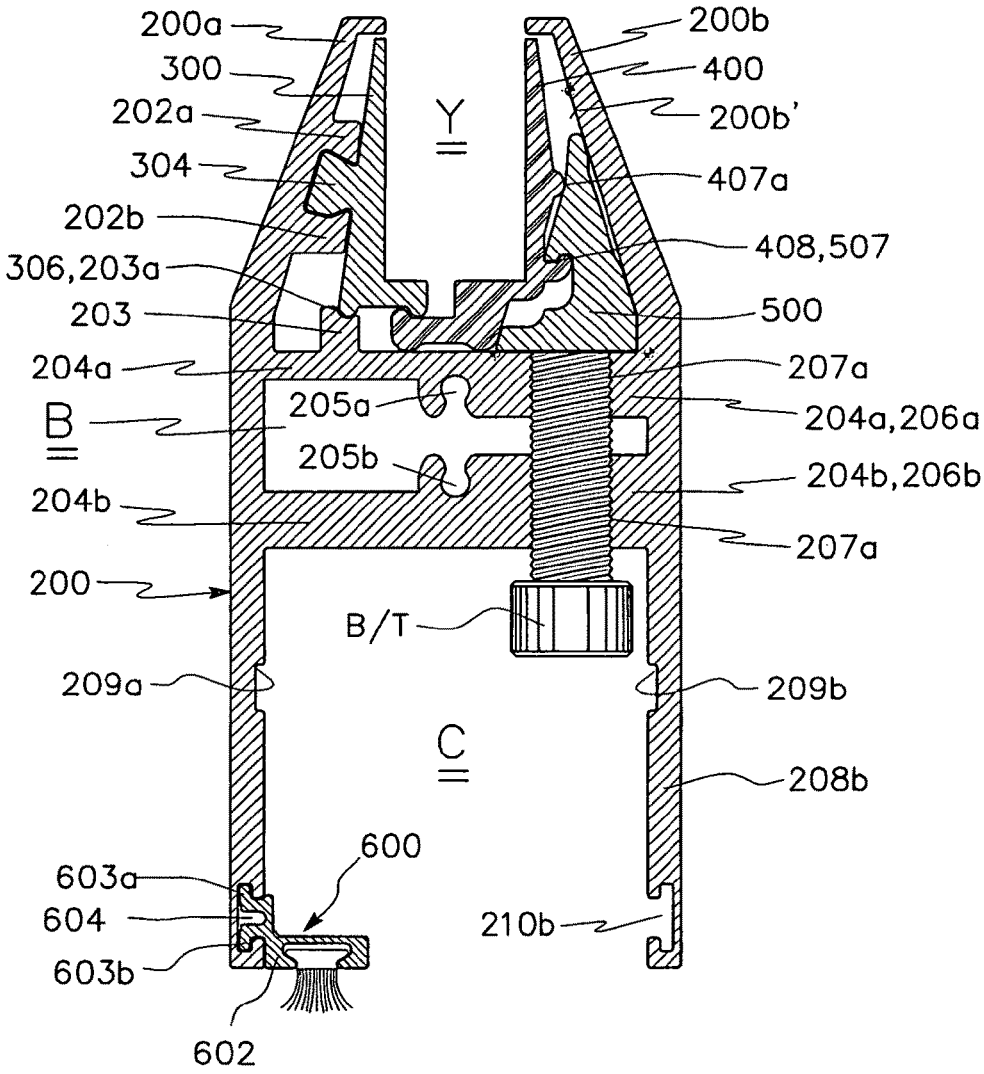
FIG. 3 is a sectional view showing an assembled state of a frame system according to the present invention.
Figure 4:
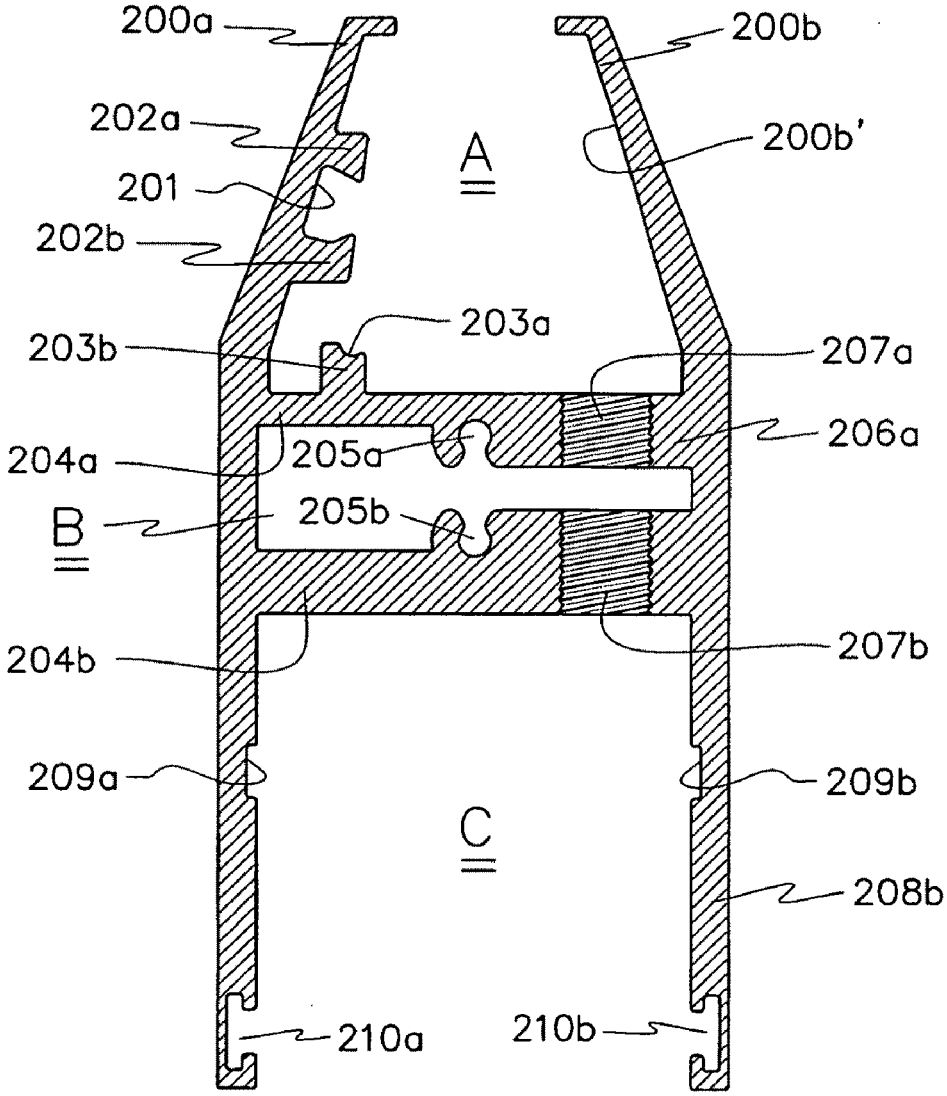
FIG. 4 is a sectional view for explaining a structure of a frame according to the present invention.
Figures 5A, 5B:
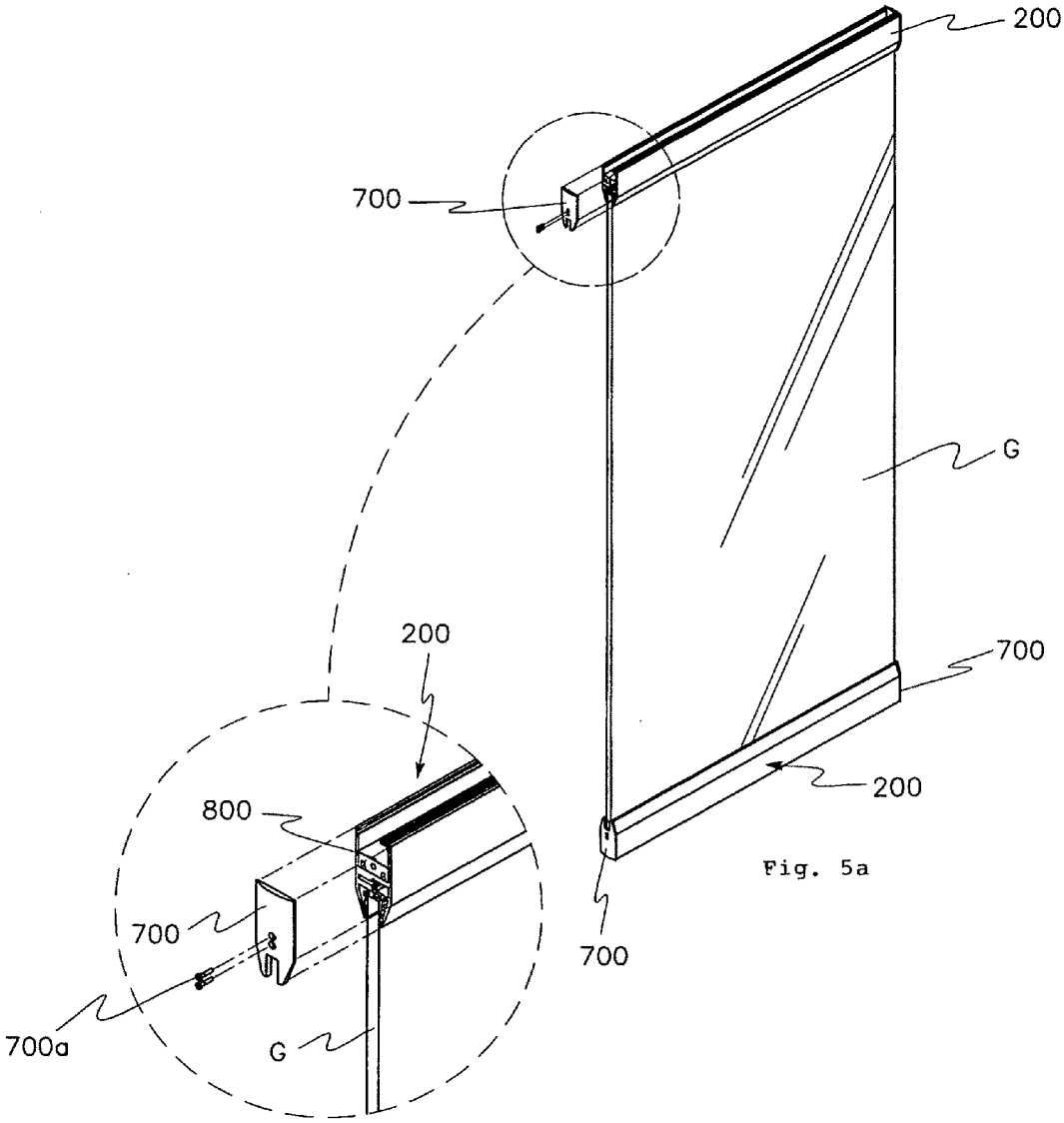
FIG. 5*a* is a perspective view showing a door finished according to the present invention.
FIG. 5*b* is an enlarged view taken along the circle of FIG. 5*a;*
Figure 6:
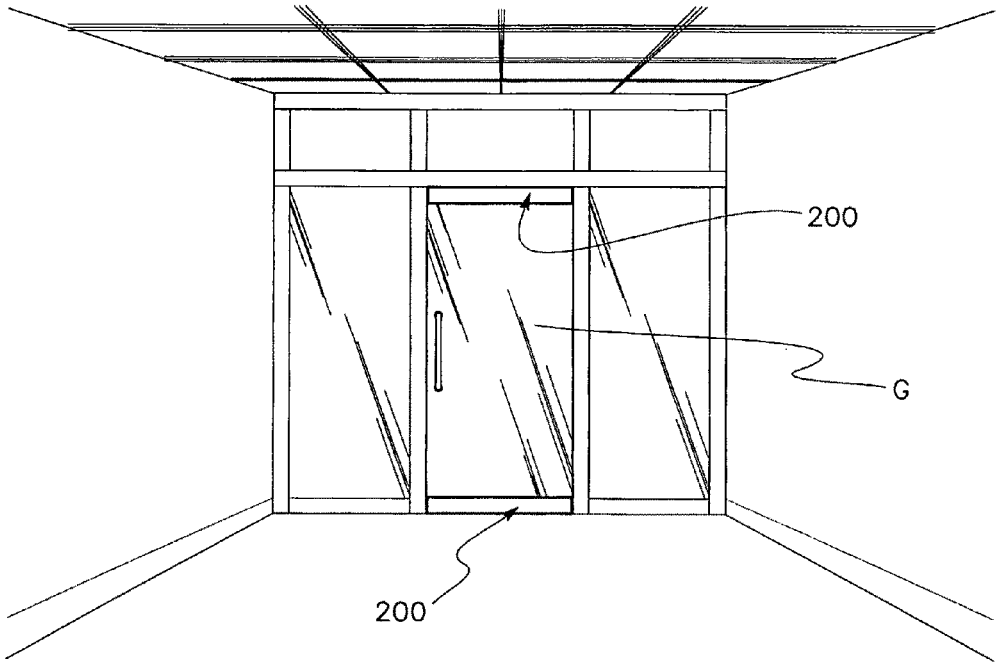
FIG. 6 is a front view showing a state where the door finished according to the present invention is installed in a building.
Figure 7:
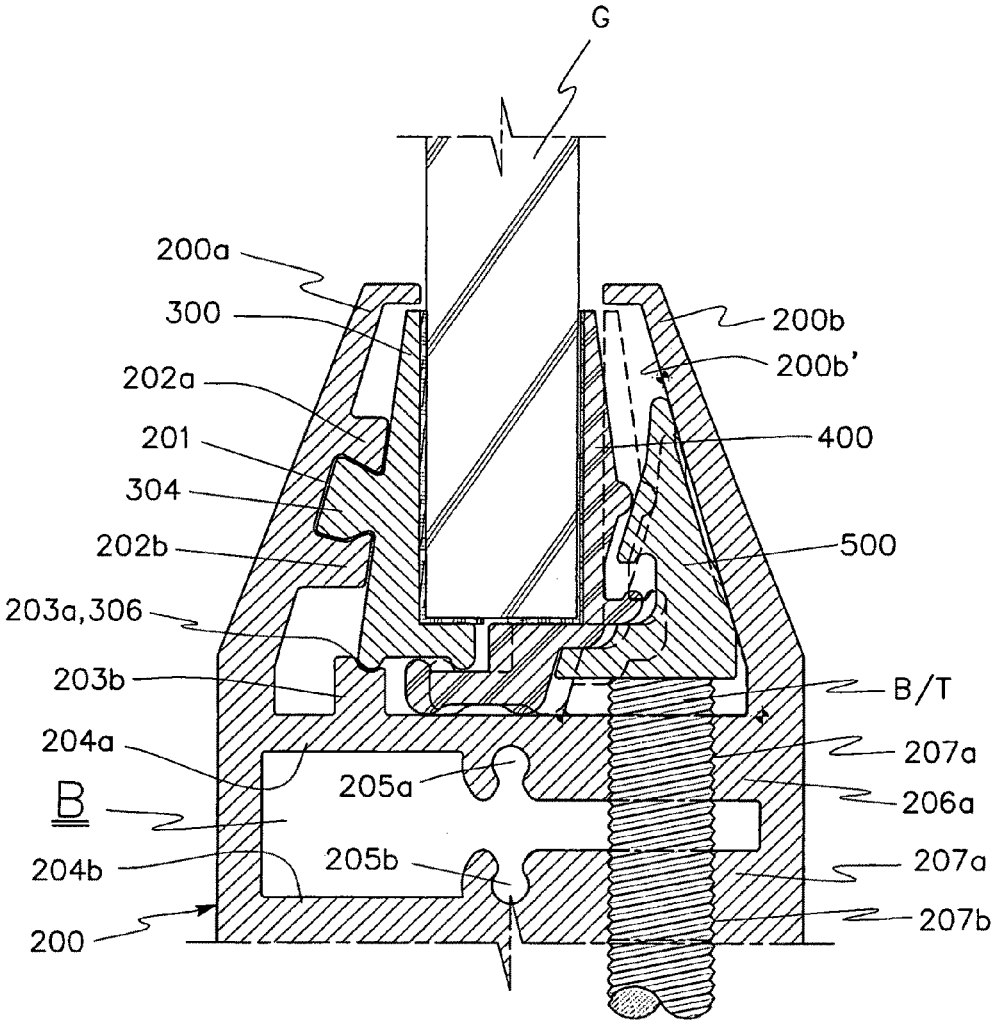
FIG. 7 is a partially enlarged sectional view of essential parts according to the present invention.
Figure 8A:
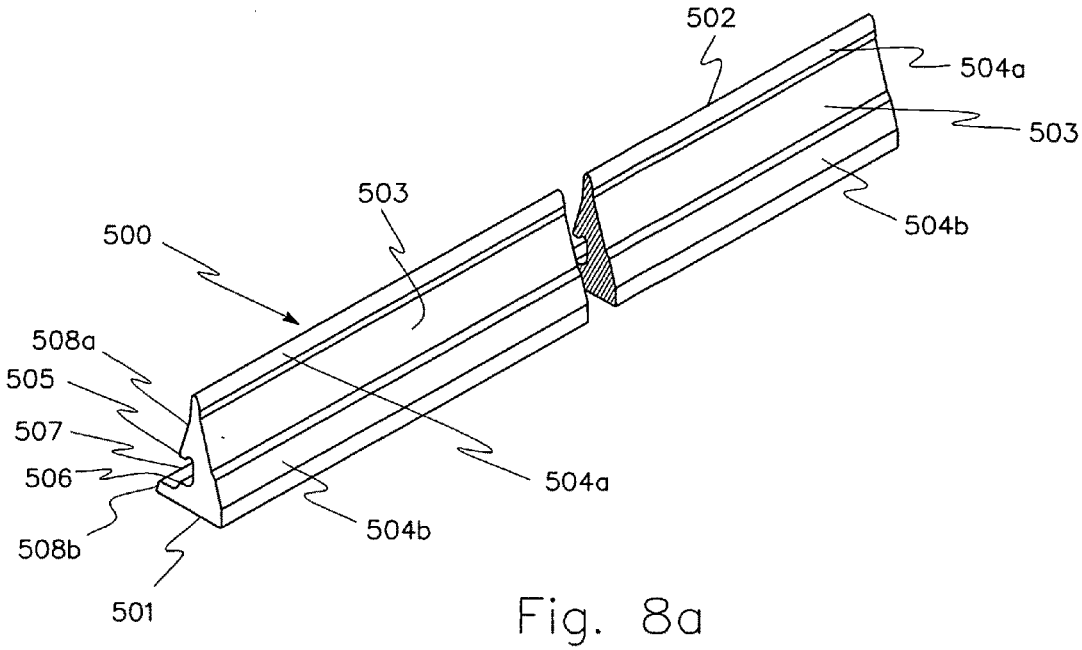
FIG. 8*a* is a perspective view of a compression rail according to the present invention.
Figure 8B:
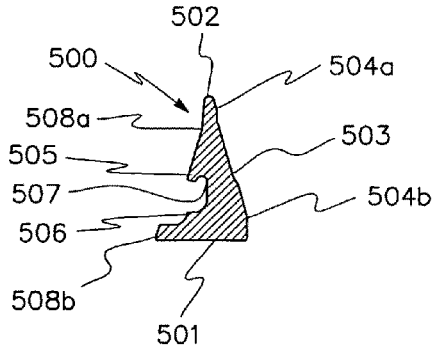
FIG. 8*b* is a sectional view of the compression rail of FIG. 8*a;*
Figure 9A:
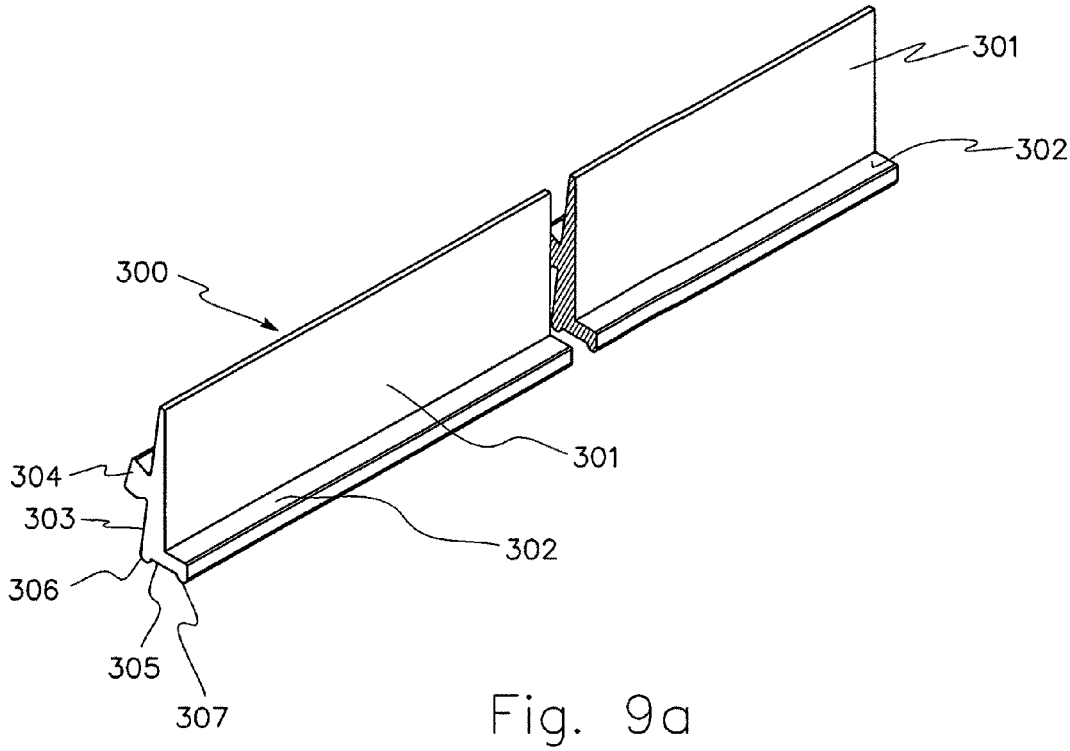
FIG. 9*a* is a perspective view of a fixed bench according to the present invention.
Figure 9B:
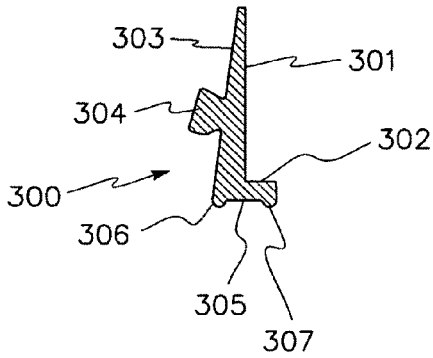
FIG. 9*b* is a sectional view of the fixed bench of FIG. 9*a;*
Figure 10:
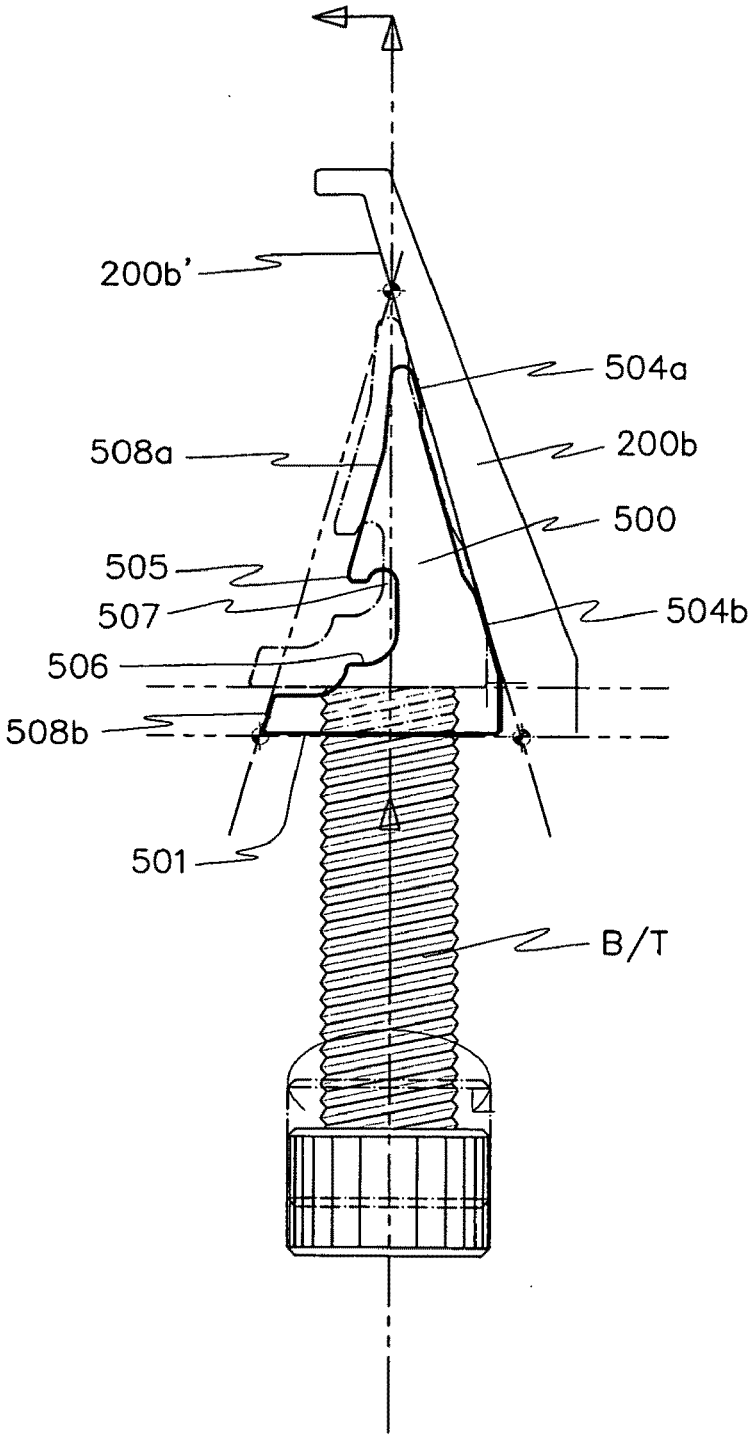
FIG. 10 is an exemplary view showing a working state of the compression rail.
Figure 11A:
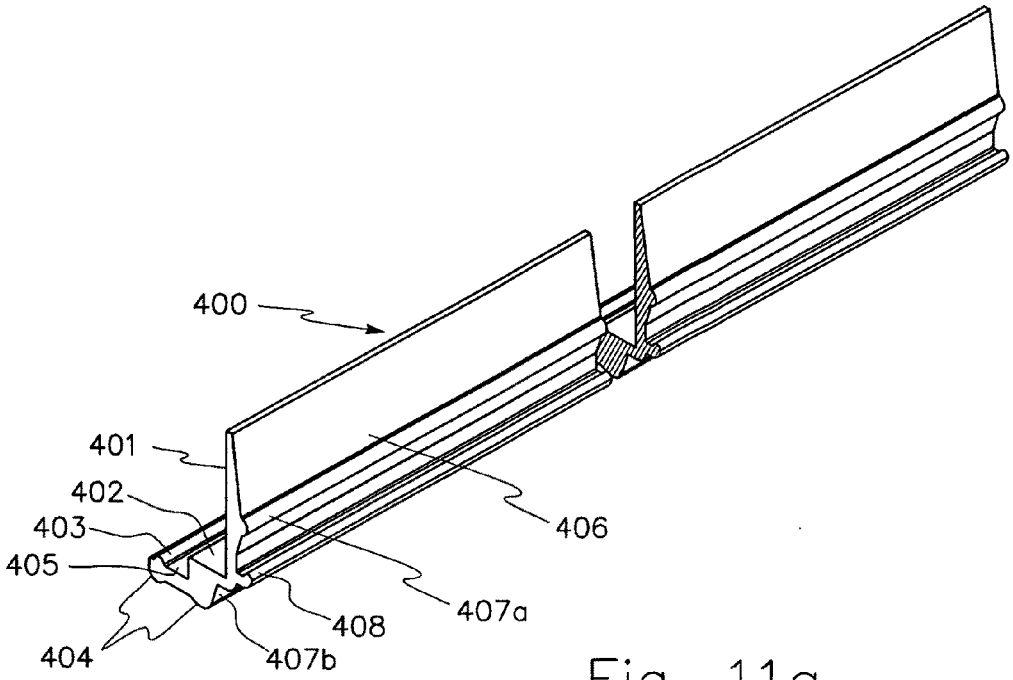
FIG. 11*a* is a perspective view of a pressure bench according to the present invention.
Figure 11B:
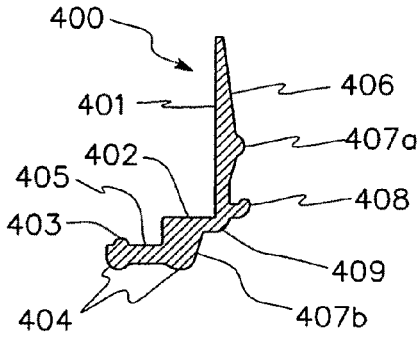
FIG. 11*b* is a sectional view of the pressure bench of FIG. 11*a;*
Figure 12:
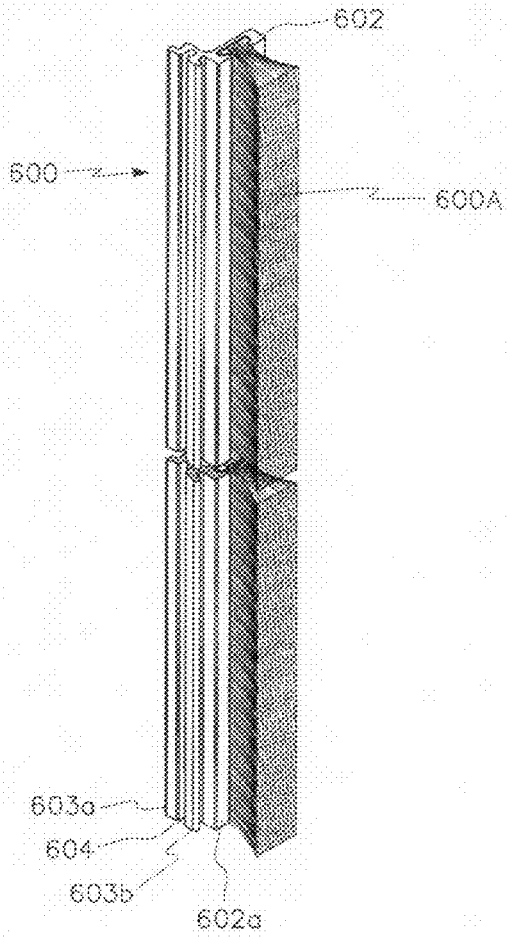
FIG. 12 is a perspective view of a brush assembly according to the present invention.
Figure 13:
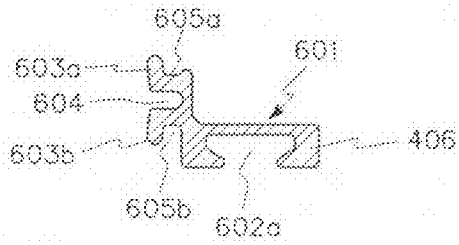
FIG. 13 is a sectional view of a brush rail in a state where a brush is removed from FIG. 12.
Figure 14A:
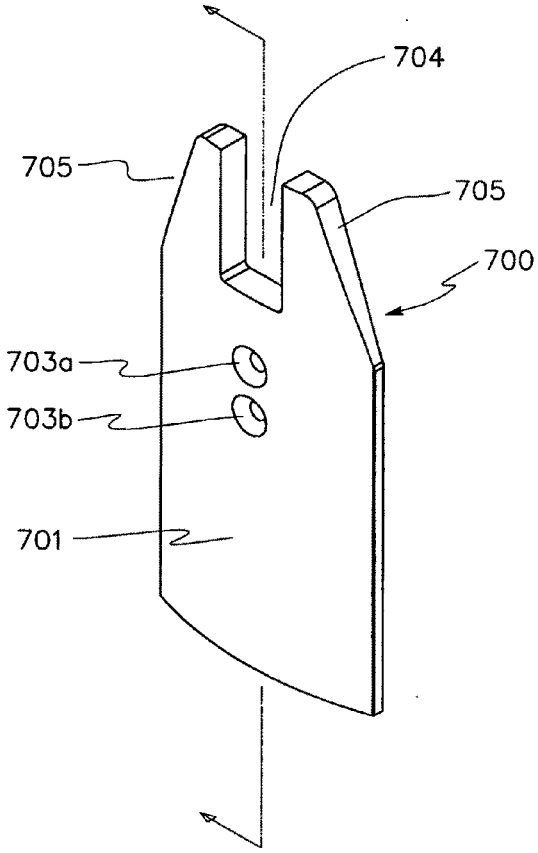
FIG. 14*a* is a perspective view of an end cap according to the present invention.
Figure 14B:
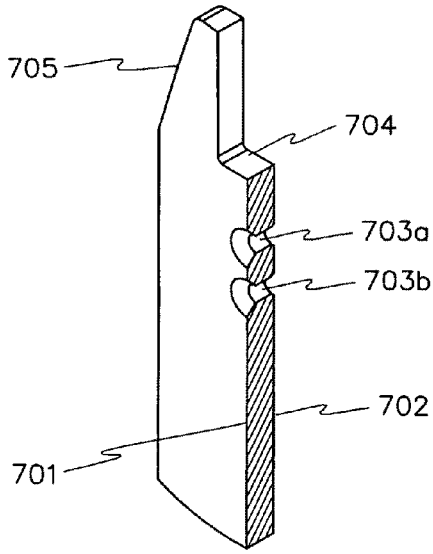
FIG. 14*b* is a sectional view of the end cap of FIG. 14*a;*
Figure 15:
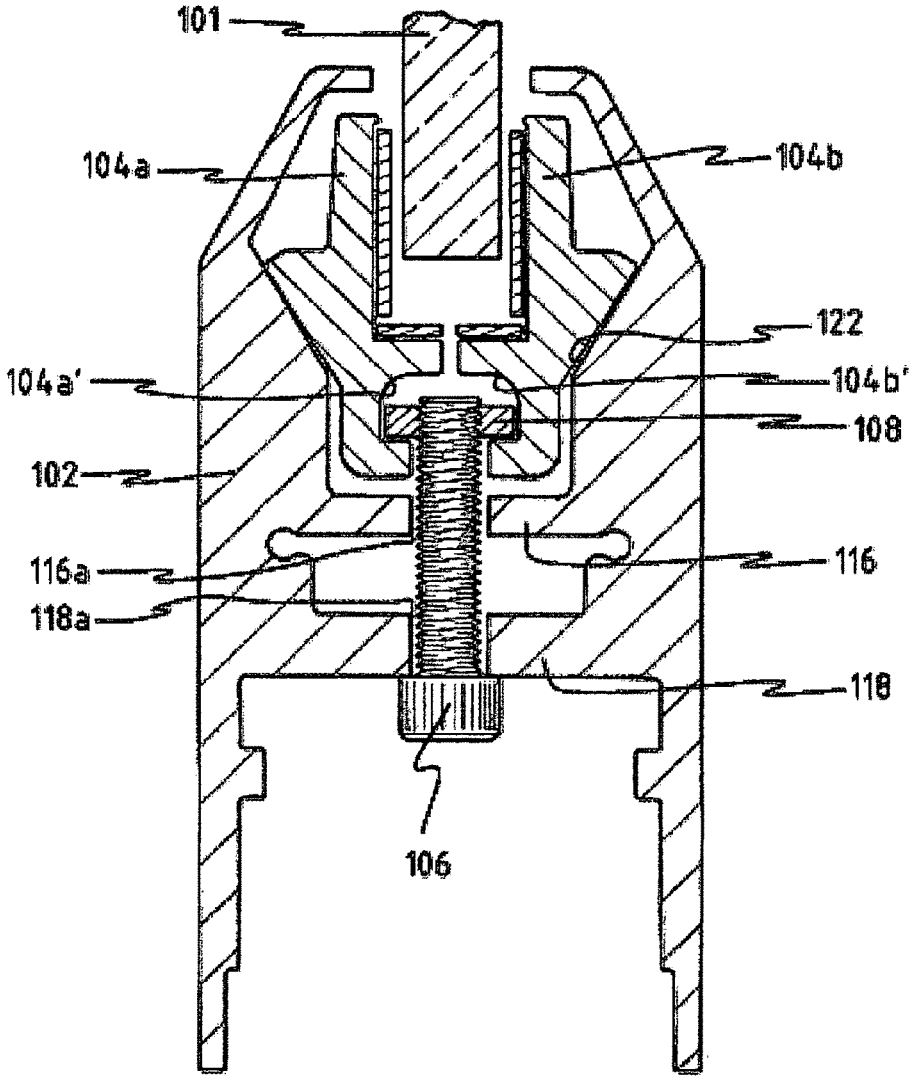
FIG. 15 is a sectional view of a prior art door rail system.
Figure 16:
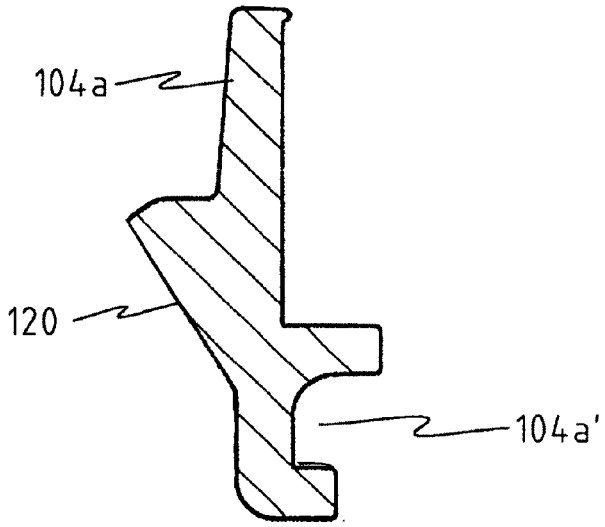
FIG. 16 is a sectional view of a clamp member of FIG. 15.
Figure 17:
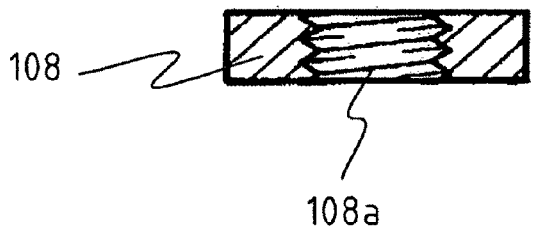
FIG. 17 is a sectional view of a nut strip of FIG. 15.

FIG. 1 is a perspective view showing an assembled state of the present invention, FIG. 2 is a front view for explaining action of the present invention, FIG. 3 is a sectional view showing an assembled state of a frame system according to the present invention, FIG. 4 is a sectional view for explaining a structure of a frame according to the present invention, FIG. 5*a* is a perspective view showing a door finished according to the present invention, FIG. 5*b* is an enlarged view taken along the circle of FIG. 5*a,* FIG. 6 is a front view showing a state where the door finished according to the present invention is installed in a building, FIG. 7 is a partially enlarged sectional view of essential parts according to the present invention, FIG. 8*a* is a perspective view of a compression rail according to the present invention, FIG. 8*b* is a sectional view of the compression rail of FIG. 8*a,* FIG. 9*a* is a perspective view of a fixed bench according to the present invention, FIG. 9*b* is a sectional view of the fixed bench of FIG. 9*a,* FIG. 10 is an exemplary view showing a working state of the compression rail, FIG. 11*a* is a perspective view of a pressure bench according to the present invention, FIG. 11*b* is a sectional view of the pressure bench of FIG. 11*a,* FIG. 12 is a perspective view of a brush assembly according to the present invention, FIG. 13 is a sectional view of a brush rail in a state where a brush is removed from FIG. 12, FIG. 14*a* is a perspective view of an end cap according to the present invention, FIG. 14*b* is a sectional view of the end cap of FIG. 14*a*, FIG. 15 is a sectional view of a prior art door rail system, FIG. 16 is a sectional view of a clamp member of FIG. 15, and FIG. 17 is a sectional view of a nut strip of FIG. 15.

Essential parts of the present invention are described below.

A door frame system according to the present invention includes: a frame 200 serving as a body to which all essential parts are combined; a fixed bench 300 fit into a bench guide groove 201 and closely contacting with a glass pane G; a pressure bench 400 combined to the front surface of the fixed bench 300, sliding only in a horizontal direction, and strongly compressing the glass pane G; a compression rail 500 pushing the pressure bench in order to move it in the horizontal direction; a tightening bolt B/T lifting the compression rail upwardly; and a brush assembly 600 for preventing contaminant and serving as a weather strip.

As shown in FIG. 4, the frame 200 serving as the body includes an upper space portion A, a middle space portion B, and a lower space portion C.

The upper space portion A of the frame 200 is in a trapezoidal form which is narrowed upwardly, and includes: inclined portions 200*a* and 200*b* formed on the wall surface thereof and getting gradually thicker downwardly; a flat guide surface 200*b*' formed on the right inclined portion 200*b* with no structure; bench guides 202*a* and 202*b* formed at the center of the other inclined portion 200*a* facing the inclined portion 200*b* and having the guide groove 201. The fixed bench 300 is combined with the frame 200. A structure of the fixed bench 300 will be described in more detail.

The middle space portion 200*b* of the frame 200 includes: a support jaw 203 having a support recess 203*a* formed at one side of the upper surface thereof; screw holes 205*a* and 205*b* facing each other, pressure sustaining portions 206*a* and 206*b* formed at sides of the screw holes 205*a* and 205*b* and reinforced thick; and bolt holes 207*a* and 207*b* formed vertically, so that the tightening bolt B/T is fastened to the frame in such a way as to direct upwardly from the bottom.

Furthermore, the lower space portion 200*c* of the frame 200 includes: vertical wall surfaces 208*a* and 208*b* formed at both sides thereof; balance member guide grooves 209*a* and 209*b* formed at the central portions of the vertical wall surfaces 208*a* and 208*b;* and brush grooves 210*a* and 210*b* formed on the lower portions of the vertical wall surfaces 208*a* and 208*b* so that the brush assembly 600 is combined to the frame 200 through the brush grooves 210*a* and 210*b*. Moreover, a balance member 800 and a hinge link 900 are also combined to the frame 200 through the balance member guide grooves 209*a* and 209*b*.

Meanwhile, as shown in FIGS. 9*a* and 9*b*, the fixed bench 300 fit to the bench guide groove 201 of the frame 200 is in a right-angled form, and includes: a high vertical wall 301 formed on one side thereof; a narrow horizontal wall 302 formed on the base side thereof; a rail 304 formed on a rear side 303 thereof in a longitudinal direction; and a stable protrusion 306 and a seating protrusion 307 formed at both sides of the base side 305. Such fixed bench 300 is fit to the guide groove 201 of the frame 200.

To combine the fixed bench 300 to the frame 200, in a state where one end portion of the rail 304 is located at the front end portion of the bench guide groove 201 of the frame and the stable protrusion 306 is located at the support recess 203*a*, the worker applies some power to the fixed bench 300 so that the fixed bench 300 is stably pushed in the longitudinal direction so as to be combined to the frame 200.

Then, the rail 304 of the fixed bench 300 is fit to the bench guide groove 201 of the frame 200, and at the same time, the rear side 303 is in close contact with the front surface of the bench guides 202*a* and 202*b*, and the stable protrusion 306 formed on the base side 305 of the fixed bench 300 is seated on the support recess 203*a* formed on the support jaw 203*b* of the frame 200, whereby the fixed bench 300 can be combined integrally with the frame 200.

Moreover, the pressure bench 400 is combined to the front side of the fixed bench 300 in such a way as to face with the fixed bench 300, and at this time, a space Y for fitting the glass pane thereof is formed between the fixed bench 300 and the pressure bench 400. As shown in FIGS. 11*a* and 11*b*, the pressure bench 400 is in a right-angled form, and includes: a high vertical wall 401 formed on the left side thereof in the drawings; a narrow horizontal wall 402; a low horizontal jaw 405 stepped downwardly from the horizontal wall 402 and having an upwardly protruding support portion 403; downwardly protruding friction portions 404 formed at both sides of the bottom surface of the low horizontal jaw 405; a pressure portion 407a protruding from the center of a rear side 406 of the vertical wall 401, the rear side 406 of the vertical wall 401 getting thicker toward the center thereof; a holding portion 408 formed below the pressure portion 407*a* and directing upwardly; and a stepped-form restriction portion 409 and an inclined pressure portion 407*b*formed beneath the holding portion 408.

Meanwhile, to combine the pressure bench 400 to the front side of the fixed bench 300, as shown in FIG. 3, the support portion 403 and the low horizontal jaw 405 are directed downwardly and fit to the base side 305 of the fixed bench 300 in such a way that they support the base side 305, and at the same time, the base side 305 and the seating protrusion 307 of the fixed bench 300 are pushed inwardly from one side end thereof in such a way that they are seated on the upper surface of the low horizontal jaw 405 and the support portion 403 of the pressure bench 400.

Then, the base side 305 and the seating protrusion 307 of the fixed bench 300 are fit to the support portion 403 and the low horizontal jaw 405 of the pressure bench 400 in such a way that they are seated on the upper surfaces of the support portion 403 and the low jaw 405. And, at the same time, the friction portion 404 of the pressure bench 400 is fit to the bridge 204*a* of the frame 200 in such a way that the friction portion 404 is seated on the upper surface of the bridge 204*a*.

Continuously, the compression rail 500 is mounted between the guide surface 200*b*' of the frame 200 and the rear side 406 of the pressure bench 400. At this time, as shown in FIGS. 8*a* and 8*b*, the compression rail 500 is in the form of a triangle when it is seen based on both sides of a base side 501 and an apex 502 in section, and includes: first upper and lower friction surfaces 504*a* and 504*b* formed partially at upper and lower portions of a rear side 503 on the right in the drawing in order to reduce a friction area; second upper and lower friction surfaces 508*a* and 508*b* formed on the left side; and a downwardly formed holding portion 505, a recess 507, and a stepped-form rising restriction portion 506 formed between the second upper and lower friction surfaces 508*a* and 508*b*. The compression rail 500 is mounted between the guide surface 200*b*' of the frame 200 and the rear side 406 of the pressure bench 400.

To combine the compression rail 500 to the frame 200, one end portion of the recess 507 is coincided with the holding portion 408 of the pressure bench 400, the second upper and lower friction surfaces 508*a* and 508*b* are coincided with the pressure portions 407*a* and 407*b* of the pressure bench 400, and the first upper and lower friction surfaces 504*a* and 504*b* of the rear side 503 are coincided with the front end portion of the guide surface 200*b*' of the frame 200. After that, the compression rail 500 is pushed in a longitudinal direction slowly.

Then, the holding portion 408 and the restriction portion 409 of the pressure bench 400 are fit to the recess 507 and the restriction portion 506 of the compression rail 500, and at the same time, the first and second upper and lower friction surfaces 504*a* and 504*b* and 508*a* and 508*b* are combined to the guide surface 200*b*' of the frame 200 and the pressure portions 407*a* and 407*b* of the pressure bench 400 in a closely contacting state.

Meanwhile, as shown in FIG. 13, the brush assembly 600 combined to one of the two brush grooves 210*a* and 21O*b* formed at the lower end portions of the vertical wall surfaces 208*a* and 208*b* of the frame 200 includes: wings 603*a* and 603*b* formed vertically; an elastic slot formed at the center between the wings 603*a* and 603*b*; a brush guide 602 formed at right angle to the wings 603*a* and 603*b*; and a brush 600A fit integrally to a brush guide groove 602*a* and having bristles which splay outwardly at the bottom ends thereof.

The assembled frame 200 is combined with the glass pane G prepared on a table or a work stand.

To combine the glass pane G with the frame 200, the worker lifts up the frame 200 with his or her hand, fits it to an end portion of the glass pane G, and then, fastens them with the tightening bolt B/T, whereby the frame 200 is fixed to the glass pane G.

In other words, the worker lifts up the assembled frame 200, locates the end portion of the glass pane G in the space Y of the frame 200 for fitting the glass pane G, and then, turns the tightening bolt B/T in a locking direction.

When the tightening bolt B/T is turned in the locking direction, the compression rail 500 minutely moves the pressure bench 400 in a horizontal direction along the guide surface 200*b*'.

That is, five bolt holes 207*a* and 207*b* formed on the pressure sustaining portions 206*a* and 206*b* of the frame 200, which has a length corresponding to a width of a door, are formed at intervals of about 5~6 inches, and the tightening bolt B/T of 8 mm is fit into each bolt hole.

Each tightening bolt B/T is turned and locked while keeping its balance till it is inserted to a predetermined depth. An end portion of the tightening bolt B/T protrudes upwardly from the pressure sustaining portions 206*a* and 206*b*, and then, the locked tightening bolt B/T is idly rotated at the base side 501 of the compression rail 500 and pushes the compression rail 500 upwardly.

In addition, while the compression rail 500 is lifted upwardly by the tightening bolt B/T, the first upper and lower friction surfaces 504*a* and 504*b* of the rear side 503 are in close contact with the guide surface 200*b*' of the frame 200, and the second upper and lower friction surfaces 508*a* and 508*b* of the opposed side are in close contact with the pressure portions 407*a* and 407*b* respectively formed at upper and lower portions of the rear side 406 of the pressure bench 400. So, the compression rail 500 slides upwardly in a state where it is in close contact with the pressure bench 400during it slides along the inclination angle of the guide surface 200*b*', so that the compression rail 500 can firmly combine the frame 200 with the glass pane G by pushing the pressure bench 400 to the left in the drawing.

After the above operation, the balance member 800 is fit into the balance member guide grooves 209*a* and 209*b* formed on the vertical wall surface 208, and then, the hinge link 900 is combined to the balance member 800 with bolts. After that, end caps 700 are positioned at both ends of the frame 200 and fastened to the frame 200 with flat countersunk head screws 700*a*. By the above process, the door, which can be installed on a door frame of the building, is finished.

As described above, the present invention can be rapidly assembled within a short time period by only one worker since the fixed bench, the pressure bench, and the compression rail are firmly fastened in the upper space portion of the frame without separation.

Moreover, the present invention can be correctly assembled in a state where the frame and the glass pane keep a straight line condition without slant and provide an exact standard without transformation in length of the door, since the glass pane is fixed to the frame and fastened by the tightening bolts without vertical movement in a state where the fixed bench is fixed and only the pressure bench is horizontally movable.

Furthermore, the present invention can provide soundproof and mothproof effects and prevent incoming of dust or foreign matters to the inside of the building, since end portions of vertical wall surfaces of the frames installed at the top and bottom of the door are ventilated but combined with the brush assembly of thick fur to filter foreign matters.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A door frame system comprising:

(a) a frame (200) serving as a body, the frame (200) comprising inclined portions (200*a*, 200*b*) increasing in width from the top to the bottom thereof and being inclined towards each other, one of the inclined portions (200*a*, 200*b*) having a flat guide surface (200*b*') and another one of the inclined portions (200*a*, 200*b*) having bench guides (202*a*, 202*b*) each having a guide groove (201), wherein a screw hole (205*a*, 205*b*) is formed at a central portion of each of top and bottom layers of a single double layer type bridge (204*a*, 204*b*), wherein bolt holes (207*a*, 207*b*) are vertically formed at sides of the screw holes (205*a*, 205*b*), and wherein vertical wall surfaces (208*a*, 208*b*) are formed extending from the bottom layer of the single double layer type bridge (204*a*, 204*b*);

(b) a fixed bench (300) comprising: a vertical wall (301) closely contacting a side of an end portion of a glass pane (G); a horizontal wall (302) formed at a right angle to the vertical wall (301) and closely contacting the end portion of the glass pane (G); a rail (304) formed at a center of a rear side (303) of the fixed bench (300) and extending in a longitudinal direction of the fixed bench (300); and a stable protrusion (306) and a seating protrusion (307) formed at both ends of a base side (305) of the fixed bench (300);

(c) a pressure bench (400) comprising: a vertical wall (401) closely contacting another side of the end portion of the glass pane (G); a horizontal wall (402) formed at a right angle to the vertical wall (401) and closely contacting the end portion of the glass pane (G); a low horizontal jaw (405) stepped downwardly from the horizontal wall (402) and having an upwardly protruding support portion (403), downwardly protruding friction portions (404) formed under the low horizontal jaw (405); a pressure portion (407*a*) widening toward a center of a rear side (406) of the vertical wall (401) of the pressure bench (400) and having a semi-circular cross-section at the center of the rear side (406) of the vertical wall (401) of the pressure bench (400); a holding portion (408); a step-shaped restriction portion (409); and an inclined pressure portion (407*b*), wherein the holding portion (408), the step-shaped restriction portion (409), and the inclined pressure portion (407*b*) are formed below the pressure portion (407*a*); and (d) a compression rail (500) comprising: first upper and lower friction surfaces (504*a*, 504*b*) formed on a rear side (503) of the compression rail (500); second upper and lower friction surfaces (508*a*, 508*b*) formed on the front side of the compression rail; a holding portion (505) formed downwardly at the central portion of the front side of the compression rail; a recess (507) formed inwardly from the holding portion (505); and a step-shaped rising restriction portion (506).

2. The door frame system according to claim 1, wherein the fixed bench (300) is assembled to the frame in such a way that the base side (305) of the fixed bench (300) keeps a predetermined space from an upper surface of the top layer (204*a*) of the single double layer type bridge (204*a*, 204*b*), wherein the support portion (403) and the low horizontal jaw (405) of the pressure bench (400) are inserted and fit between the base side (305) of the fixed bench (300) and the top layer (204*a*) of the single double layer type bridge (204*a*, 204*b*), wherein the holding portion (408) formed on the rear side (406) of the pressure bench (400) is inserted into the recess (507) of the compression rail (500) so as not to be separated from the holding portion (505) of the compression rail (500), wherein the compression rail (500) is fit between the pressure bench (400) and the guide surface (200*b*') of the frame (200), whereby the fixed bench, the pressure bench and the compression rail can be firmly combined with the frame without an additional fixing device.

3. The door frame system according to claim 1, wherein the frame (200) includes a support jaw (203) having a support recess (203*a*) formed at one side of an upper surface of the top layer (204*a*) of the single double layer type bridge (204*a*, 204*b*), wherein the screw holes (205*a*, 205*b*) are formed in a straight line at an interval of approximately seven (7.0) to thirteen (13.0) millimeters from each other and cut and opened in a direction that they face each other, wherein reinforced pressure sustaining portions (206*a*, 206*b*) are formed at the same height as the corresponding screw holes (205*a*, 205*b*), wherein the bolt holes (207*a*, 207*b*) comprise a plurality of thread grooves.

4. The door frame system according to claim 1, further comprising a brush assembly (600) including a brush and being is combined with one of brush grooves (210*a*, 210*b*) formed on the vertical wall surfaces (208*a*, 208*b*) of the frame (200), wherein the brush assembly (600) comprises wings (603*a*, 603*b*) which fit into the one of the brush grooves (210*a*, 210*b*), wherein a brush guide groove (602*a*) is formed at a right angle to the wings, and wherein the brush (600A) has bristles with ends that splay outwardly at the bottom thereof.

* * * * *